United States Patent [19]

Ruddock

[11] Patent Number: 4,533,120

[45] Date of Patent: Aug. 6, 1985

[54] FENCING RAIL MEMBERS

[76] Inventor: Bernard J. Ruddock, Animart, Ashbrook, Shipley, Horsham, West Sussex, RH13 8PE, England

[21] Appl. No.: 588,729

[22] Filed: Mar. 12, 1984

[51] Int. Cl.[3] ..... B21F 27/00

[52] U.S. Cl. ..... 256/52; 256/49; 256/10

[58] Field of Search ..... 256/10, 19, 32, 46, 256/47, 13.1, 48, 52, 49

[56] References Cited

U.S. PATENT DOCUMENTS 3,233,870 2/1966 Gerhardt ..... 256/13.1
4,465,263 8/1984 Robbins, Jr. ..... 256/52

FOREIGN PATENT DOCUMENTS 571196 12/1957 Italy ..... 256/13.1
855130 11/1960 United Kingdom .

*Primary Examiner*—Andrew V. Kundrat
*Attorney, Agent, or Firm*—Walter C. Farley

[57] ABSTRACT

A composite member for use as a substitute for a wooden rail in fencing, especially in agricultural and farming, where livestock need to be confined, which reduces the danger of damage to the livestock, but provides for safety and security.

The proposed composite member comprises a plurality of wire members, 1A and 1B, possibly of stranded wire, coated and spaced apart by a synthetic resin material 2 forming a web, which preferably has one or more longitudinal ribs 2A to facilitate coiling for storage or transit, enhance appearance, and provide for color coding.

6 Claims, 2 Drawing Figures

FENCING RAIL MEMBERS

The invention relates to a composite member for use as a substitute for a wooden rail in fencing, especially in agricultural and farming, where livestock need to be confined. Particular problems are presented by the need to restrain horses in an economical manner, but with safety and security.

Wooden fencing rails are in common use, but these suffer the disadvantages of high installation and maintenance costs, and may be subjected to chewing, especially by horses, which not only leads to a weakened and unsightly fence, but leads to possible damage from splinters, especially when such a rail is eventually broken.

As an economic alternative it has become a common practice to utilise wire as a fencing rail member, but this is unsatisfactory in that it cannot be used readily to provide any aesthetic visual effect, because it is not easily visible, and this in turn leads to the danger of animals being injured by running into such fencing, especially because broken strands can get wound up about an animals legs.

One object of the present invention is to provide a fencing rail member that avoids the above-mentioned disadvantages to a significant degree, whilst being economic, simple and effective.

According to one aspect, in accordance with the present invention there is provided a fencing rail member having a plurality of longitudinally extending wire strands spaced mutually parallel by a coating of synthetic resin material which extends between said strands to form a relatively broad band having a transverse width at least ten times the thickness of the web.

Advantageously the thickness of the web is substantially equal to that of the wire strands, which are of mutually equal diameter, and a transverse width of thirty times the web thickness may be found to be preferable for many fields of use.

The web may not be of constant thickness, but may be provided with one or more longitudinally extending ribs, mutually parallel to said strands, and having a thickness substantially equal to that of said strands.

According to another aspect of the invention there is provided a fence comprising posts secured at spaced intervals to an assembly having a plurality of mutually parallel fencing rail members constructed in accordance with the invention.

Figure 1:
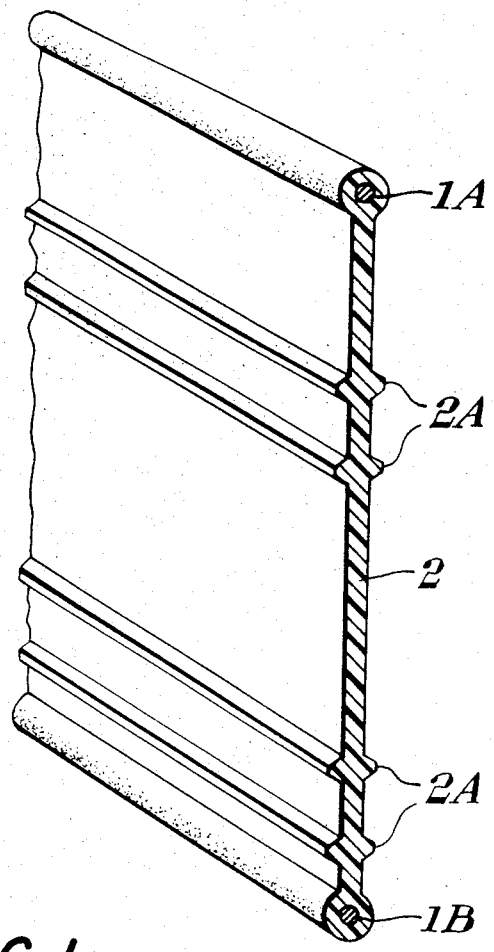
Figure 2:
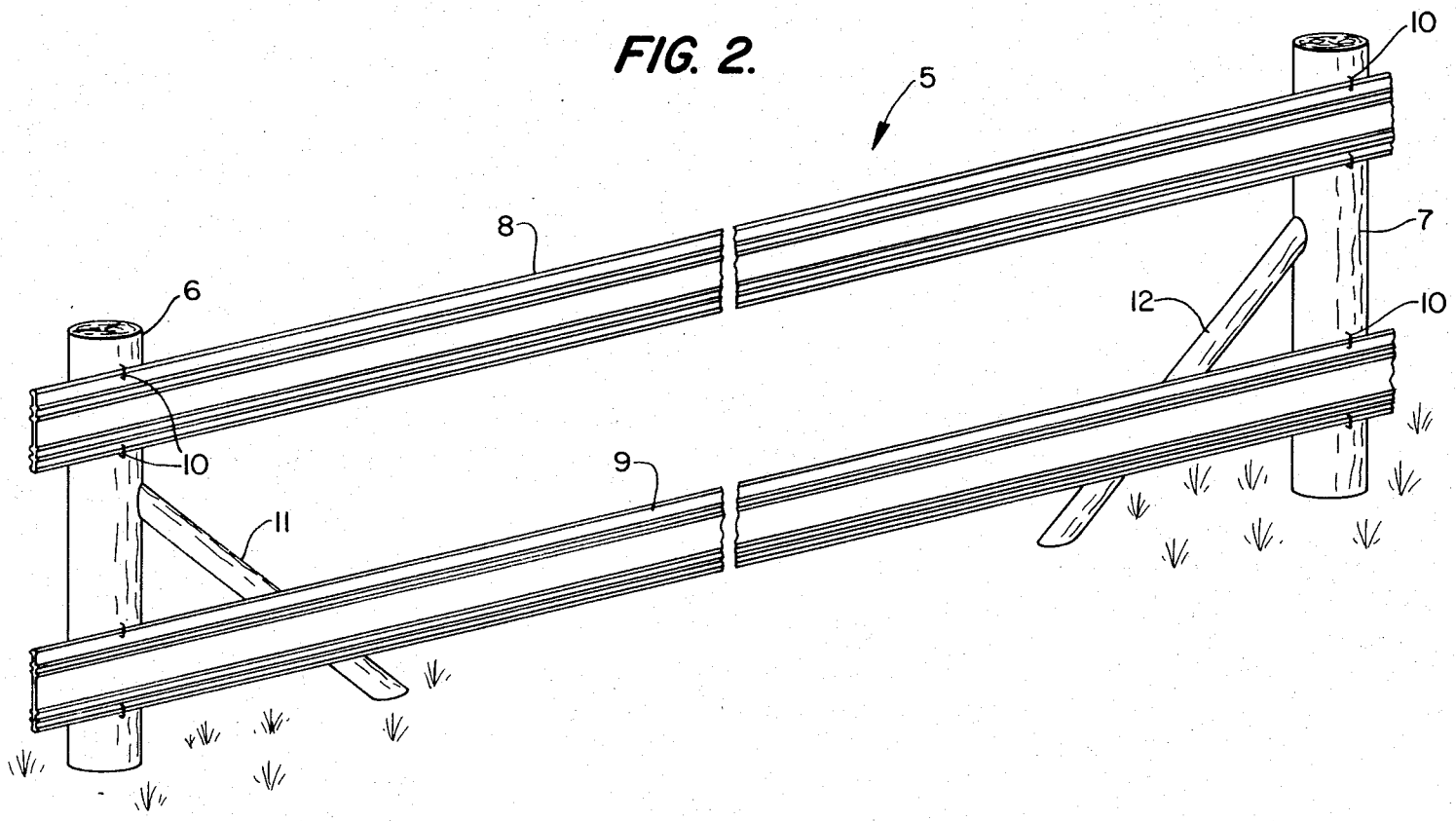

The invention will now be described with reference to the drawings wherein:

FIG. 1 is a sectional perspective view of an embodiment of a fencing rail member in accordance with the invention; and FIG. 2 is a partial perspective foreshortened view of a fence constructed with rail members of the type shown in FIG. 1.

In the illustrated embodiment, two strands, 1A and 1B, of steel wire 2.5 mm in diameter are encased in a p.v.c. web 2 having a minimum thickness of 2.5 mm, and an overall width of 75 mm.

To enhance the appearance and improve the strength of the member, a plurality of mutually parallel ribs 2A are provided, preferably in a symmetrical configuration with respect to the longitudinal centre line. These can facilitate the formation of a tidy, firm roll for storage and packing, if they are mutually staggered when rolled.

The term rail member has been used for the composite assembly, although it will be appreciated that with the dimensions given for the preferred embodiment, the rail member will be quite flexible, and can be stored and handled in rolls before use. The member can be formed in a simple extrusion process, and the web can be of any selected uniform colour, or may be provided with coloured stripes to give easily recognisable identification of particular enclosure, for example.

Obviously more than two strands of wire can be incorporated, possibly one at each rib position for example. Although reference has been made to steel wire, this is not essential, and in some particular conditions other metals may be considered advantageous, and if necessary each wire may be of multi-stranded form. For example, in certain cases it may be advantageous to combine the re-inforcement effect of the wire with an additional function, namely the supply of electrical power. This could be of use where remote light or power sources may be required, and/or remote signalling. The presence of at least two conductors in a fencing member might be exploited to provide a security alarm circuit. If connections at one end are completed via a shorting link fitted to a gate, there will be an available signal when the gate is opened in the case of a security application, or a control signal can be passed to a motor or latch in order to open or close a gate in the case of remote operation. Since most assembled fences will comprise more than one fencing member, different functions can be performed by different members, one being used for a remote control operation and another to monitor that the operation is satisfactorily completed. In the security alarm circuit the presence of a loop is advantageous as it enables a monitoring current to be passed, which will sense any cutting or breaking of a fencing member, and can be used to trigger an alarm. Most of the described functions can be performed with reliability, using low tension supply sources and appropriate current-limiting means, so that there need be no hazard to personnel or to livestock. A wire may form a proximity detector electrode.

An assembled fence can be swiftly erected by providing suitably positioned posts, 5, a portion of which is shown in FIG. 2 and simply stapling or otherwise securing strips 8 and 9 of the fencing member at each post, 6 and 7 for example by a respective staple 10 over each re-inforcing wire. End posts will require struts 11 and 12 to enable any straight runs of the fencing rail members to be maintained under tension. Intermediate joints can be made by cutting members and over-lapping them at a convenient post. The anchoring of a member at the end of a fence can be arranged in the manner most convenient for the particular circumstance, e.g. whether it is a terminal post, corner post, or gate, for example.

The resultant fence with posts at intervals along a plurality of mutually parallel, suitably spaced fencing rail members has a strength and resilience such that it cannot be easily damaged by animals, whose impact will be gently repelled, and yet the fence can be most attractive aesthetically, whilst calling for relatively low installation costs, with reduced construction time, and virtually negligible maintenance costs.

The arrangement of the ribs is most advantageous for rolling and packing, as well as providing distinctive fencing sections having different configurations or colours. By forming the ribs symmetrically on each face about the central plane and mutually staggering them with reference to the longitudinal centre-line, they can be arranged to interlock when rolled up for packing, to form a rigid coil, as will be seen by examination of the configuration shown in the illustration.

I claim:

1. A fencing rail member comprising a plurality of longitudinally extending wires, a web of synthetic resin material covering and extending between said wires and maintaining said wires in spaced, parallel relationship, said web having a transverse width at least ten times its thickness, said web including a plurality of longitudinal ribs extending substantially parallel with said wires, the thickness of each of said ribs being substantially equal to the thickness of said wires and their covering, and said ribs being offset different distances from the longitudinal center line of said web so as to interlock when the web is rolled.

2. A fencing rail member as claimed in claim 1, in which the thickness of the web is substantially equal to that of the wires, which are of mutually equal diameter.

3. A fencing rail member as claimed in claim 1, in which said web has a transverse width substantially thirty times the thickness of said web.

4. A fence comprising a plurality of posts secured at spaced intervals to form a series of gaps;

a plurality of substantially parallel, vertically spaced fencing rail members, each of said rail members comprising a plurality of longitudinally extending wires, and a web of synthetic resin material substantially covering and extending between said wires and maintaining said wires in spaced, parallel relationship, said web having a transverse width at least ten times its thickness;

each said web includes a plurality of longitudinal ribs extending generally parallel with said wires, the thickness of each of said ribs being substantially equal to the thickness of said wires and their covering, said ribs being offset different distances from the longitudinal center line of said web so as to interlock when the web is rolled; and a plurality of driven fasteners penetrating said webs and entering said posts to hold said rail members thereto; and means for maintaining substantially straight ones of said rail members in tension.

5. A fence according to claim 4 wherein the thickness of each said web is substantially equal to that of said wires.

6. A fence according to claim 5 wherein each said web has a transverse width substantially thirty times the thickness of said web.

* * * * *